US005966978A

United States Patent [19]

Kneppe et al.

[11] Patent Number: 5,966,978

[45] Date of Patent: Oct. 19, 1999

[54] REELING UNIT FOR STRIP

[75] Inventors: Günter Kneppe, Hilchenbach; Martin Braun, Kreuztal, both of Germany

[73] Assignee: SMS Schloemann-Siemag Aktiengesellschaft, Düsseldorf, Germany

[21] Appl. No.: 08/798,090

[22] Filed: Feb. 12, 1997

[30] Foreign Application Priority Data

Feb. 14, 1996 [DE] Germany ..... 196 05 293
May 23, 1996 [DE] Germany ..... 196 20 696

[51] Int. Cl.[6] ..... B21B 1/00

[52] U.S. Cl. ..... 72/203; 72/251

[58] Field of Search ..... 72/203, 205, 250, 72/251; 242/528, 535.4

[56] References Cited

U.S. PATENT DOCUMENTS

| | | | |
|---|---|---|---|
| 3,304,023 | 2/1967 | O'Brien . | |
| 3,835,681 | 9/1974 | Shumaker | 72/203 |
| 4,054,046 | 10/1977 | Eibe . | |
| 4,316,376 | 2/1982 | Masui et al. | 72/250 |

FOREIGN PATENT DOCUMENTS

| | | | |
|---|---|---|---|
| 2048127 | 2/1992 | Canada | 72/203 |
| 0469483 | 2/1992 | European Pat. Off. . | |
| 2635094 | 2/1990 | France . | |
| 62-104604 | 5/1987 | Japan | 72/203 |
| 6-154855 | 6/1994 | Japan | 72/203 |

*Primary Examiner*—Joseph J. Hail, III
*Assistant Examiner*—Ed Tolan
*Attorney, Agent, or Firm*—Friedrich Kueffner

[57] ABSTRACT

A method and device for alternatingly operating one of several reels arranged following a continuous strip rolling mill, wherein the continuously arriving rolling stock is cut into coil weights of desired lots by means of flying shears provided at the exit of the rolling mill. At least one driver is arranged following the flying shears, wherein the rolls of the driver can be displaced in such a way that the plane extending through the two axes of the rolls can be pivoted from an essentially vertical position such that a normal extending relative to this plane is pivoted in the direction toward the first of the following reels

9 Claims, 6 Drawing Sheets

REELING UNIT FOR STRIP

BACKGROUND OF THE INVENTION

1. Field of the Invention

The present invention relates to a method of alternatingly operating one of several reels arranged following a continuous strip rolling mill, wherein the continuously arriving rolling stock is cut into coil weights of desired lots by means of flying shears provided at the exit of the rolling mill. The invention also relates to a device for operating reels in accordance with the method.

2. Description of the Related Art

Continuous rolling mills which are fed continuously with rolling stock from continuous casting plants, or continuous rolling trains in which the rolling stock lots arriving from a roughing train are connected to each other in front of the first stand of the train, are known in the art. A driver is usually arranged following the continuous rolling mill, wherein a required strip tension at the output of the continuous rolling train is adjustable by means of the driver. Flying shears as well as another driver are arranged following the first driver. The continuously arriving rolling stock is divided by means of the flying shears into such lengths that, after the lots have been wound up, desired coil weights are obtained. A second reel is provided in order to be able to wind up the strip beginning which follows after a relatively short time period the strip end of the strip wound onto the first reel after the transverse cutting of the strip. This is necessary because, as a rule, it is not possible to stop the strip beginning and to pull the previously wound coil from the first reel and subsequently to start winding again onto the first reel.

Turning reels, in which the strip beginning is wound onto the reel in one position of the reel, have also already become known in the art. As soon as the strip rests against the reel without slip, the reel can be moved during its reeling operation into the coil removing position and the second reel of the turning reel is rotated from this position into the position for starting reeling. However, since turning reels are very complicated, they are very expensive and cannot always be used economically following continuous rolling trains.

Separately arranged reels, to which the rolling stock beginning is fed through switches, have also become known. In order to prevent the switches from permanently resting against the rolling stock, the switches must be switched very quickly precisely within that period of time after the end of the rolled strip has passed the switch and before the new beginning of the rolled strip enters the switch. Because of the high outlet speeds of continuous rolling trains, it is necessary to use very fast and complicated rolling switches. However, such switches fail because of the very high outlet speeds of thin strips used today and because of the very short time period between the new strip beginning and the preceding strip end.

SUMMARY OF THE INVENTION

Therefore, it is the primary object of the present invention to further develop a method of alternatingly operating reels following continuous rolling trains and a device for carrying out the method in such a way that even with the use of inexpensive reels, it is possible to safely direct the individual rolling stock lots to the respective reels even at very high speeds of the rolling stock and very short periods between strip end and strip beginning.

In accordance with the present invention, the above object is met by providing at least one driver following the flying shears, wherein the rolls of the driver can be displaced in such a way that the plane extending through the two axes of the rolls can be pivoted from an essentially vertical position such that a normal extending relative to this plane is pivoted in the direction toward the first of the following reels.

Accordingly, if the rolls of the driver are arranged vertically or almost vertically above each other, the strip beginning entering the driver is not deflected. The strip travels along a straight line toward the following driver. Guide belts can be provided to assure a safe and obstacle-free transport of the rolled strip. However, if one of the driver rollers is arranged displaced relative to the other in horizontal direction, so that the normal relative to the plane extending through the axes of the rolls extends toward the reel assigned to the driver, the strip beginning entering the driver adjusted in this manner will be deflected toward this reel. By adjusting the driver rolls into different positions relative to each other, it is also possible to direct the strip beginning toward different reels or to additional drivers.

Of particular significance is the fact that the position for feeding strip to a reel is adjusted during the operation of the second reel. As soon as the reel following the driver has wound the first windings of a lot without slip, the driver can be adjusted already during the reeling operation, so that the next rolled strip lot is wound onto another reel. It is not necessary to carry out fast pivoting movements during the time when the end of a rolled strip lot leaves the driver and the beginning of the next rolled strip lot enters the driver.

In the device according to the present invention for carrying out the method, a driver is arranged following the flying shears which, in turn, are arranged following the strip rolling mill, wherein the rolls of the driver are provided with an arrangement acting on the rolls for horizontally displacing the rolls in the strip travel direction or opposite the strip travel direction.

The arrangement for horizontally displacing the rolls of the driver makes it possible that at least one of the driver rolls can be displaced relative to the other roll in such a way that the entering strip beginning is deflected in the direction toward the reels arranged at different fixed positions following the driver. Although the horizontal displacement can be carried out into any desired positions of the driver rolls and, thus, many different deflection angles of the strip beginning could be carried out, preferably two or at most three different positions of pivoting one driver roll relative to the other driver roll can be adjusted.

If it is desired to be able to adjust the driver rolls into various different positions, it is useful to provide a position control which is capable of moving the pivoting drives of the driver roll into the exact pivoted position. One of the positions is the position in which the rolls are arranged vertically above each other, so that the strip beginning travels in a straight line through the driver. Another position is obtained by pivoting one of the driver rolls in the strip travel direction against a stop. A third position is obtained by pivoting the driver roll opposite the strip travel direction against another stop.

In accordance with a particularly important feature, a control unit is provided which controls the horizontal displacement drive and which, after the strip beginning has been grasped without slip by one of the reels and while this reel is still being operated, an adjustment of the horizontally displaceable driver roll is effected in such a way that the next strip beginning entering the driver is deflected toward another reel or toward another driver. There is always sufficient time available during the reeling process for carrying out the horizontal displacement of the driver roll, so that it is not necessary to provide especially fast, strong-pulse drives for the horizontal displacement drive. The time is always sufficient for safely adjusting the driver and, thus, for ensuring a safe deflection of the next strip beginning.

The driver roll which is supported by a pair of support members and is vertically adjustable could be mounted on horizontal linear guides. However, it is useful to arrange the pivot bearings of the pair of support members for vertically adjusting the driver roll on a pivoted lever whose lever arms supporting the pivot bearings of the pair of support members can be moved essentially in horizontal direction in the strip travel direction and opposite the strip travel direction.

It is essential that the pivoting path of the pivot levers is limited by stops. When the pivoting levers are adjusted tightly against the stops and are secured or locked in this position during the deflection of the strip beginning, vibrations of the driver roll can be prevented and, thus, a clean deflection of the strip beginning is made possible.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
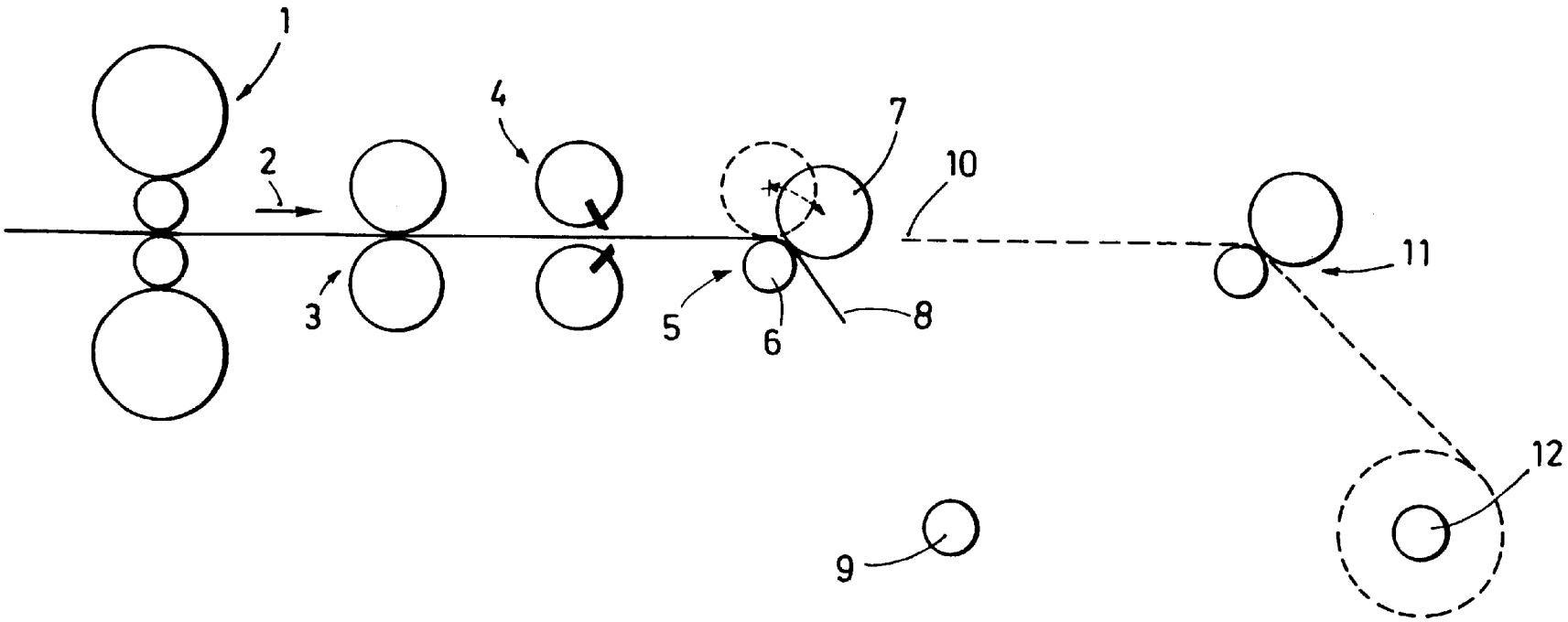
FIG. 1 is a schematic view of an embodiment of a reeling device at the exit of a continuous strip rolling mill.

FIG. 1 of the drawing schematically shows the last stand 1 of a continuous strip rolling train. The stand 1 is followed in strip travel direction 2 by a driver 3 and flying sheers 4 for dividing the sometimes very thin strip continuously entering at high speed into lengths corresponding to the desired lots A driver 5 is provided following the flying shears 4. The driver 5 has a stationary roll 6 and a roll 7 which is adjustable and displaceable in horizontal direction. The adjustment of the roll 7 is effected by a control unit. In the illustrated position, the driver 5 deflects the strip beginning 8 toward the reel 9, while, as shown in broken lines, the strip end 10 of the preceding lot is still travelling through the driver 11 toward the reel 12.

The roll 7 has been pivoted already during the operation of the reel 12 in such a way that the strip beginning of the next rolling stock lot following the strip end 10 is deflected toward the reel 9.

Figure 1A:
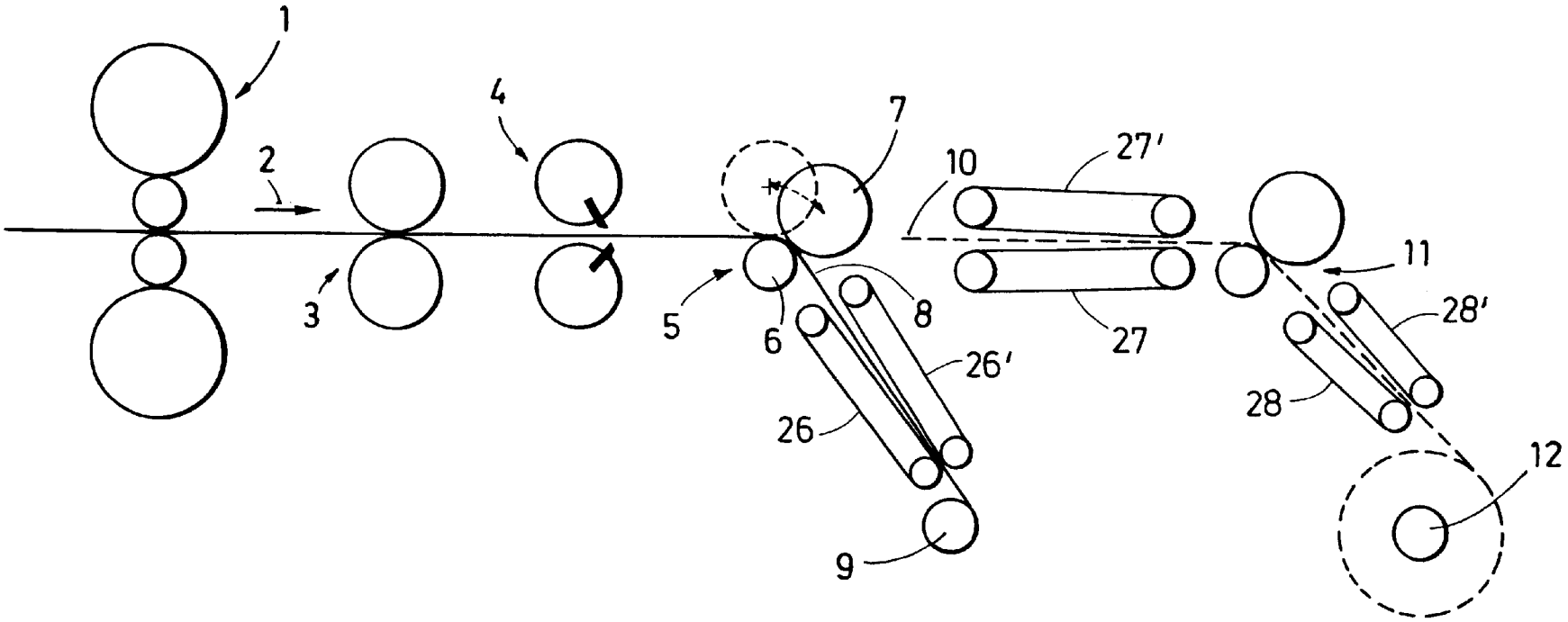
FIG. 1*a* is a schematic view of the reeling device of FIG. 1 with guide belts for the rolled strip.
Figure 1B:
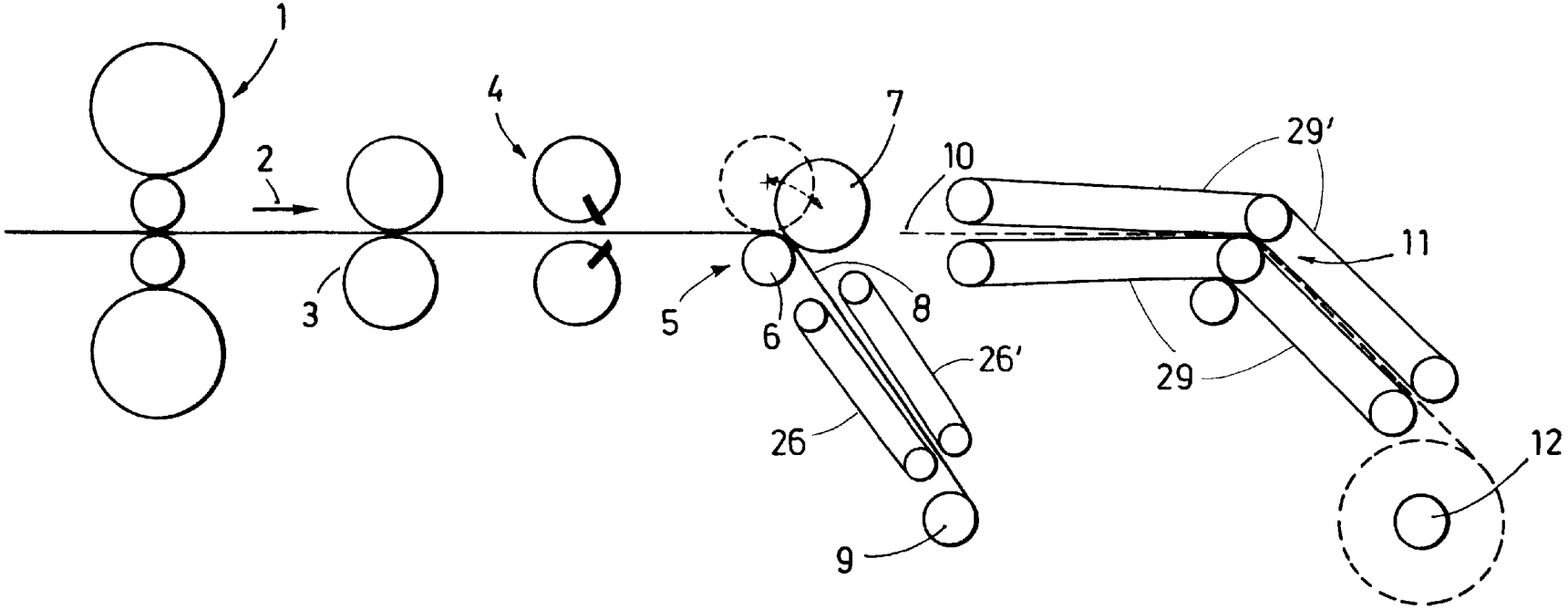
FIG. 1*b* is a schematic view of the reeling device according to FIG. 1 with another possibility for arranging the guide belts for the rolled strip.

FIGS. 1*a* and 1*b* show guide belts 26, 26'; 27, 27'; 28, 28'; 29, 29' which are capable of guiding the rolled strip therebetween. Endless belts are guided around guide rollers which are mounted in such a way that the pairs of guide belts form therebetween an inlet funnel for the rolled strip.

Figure 2:
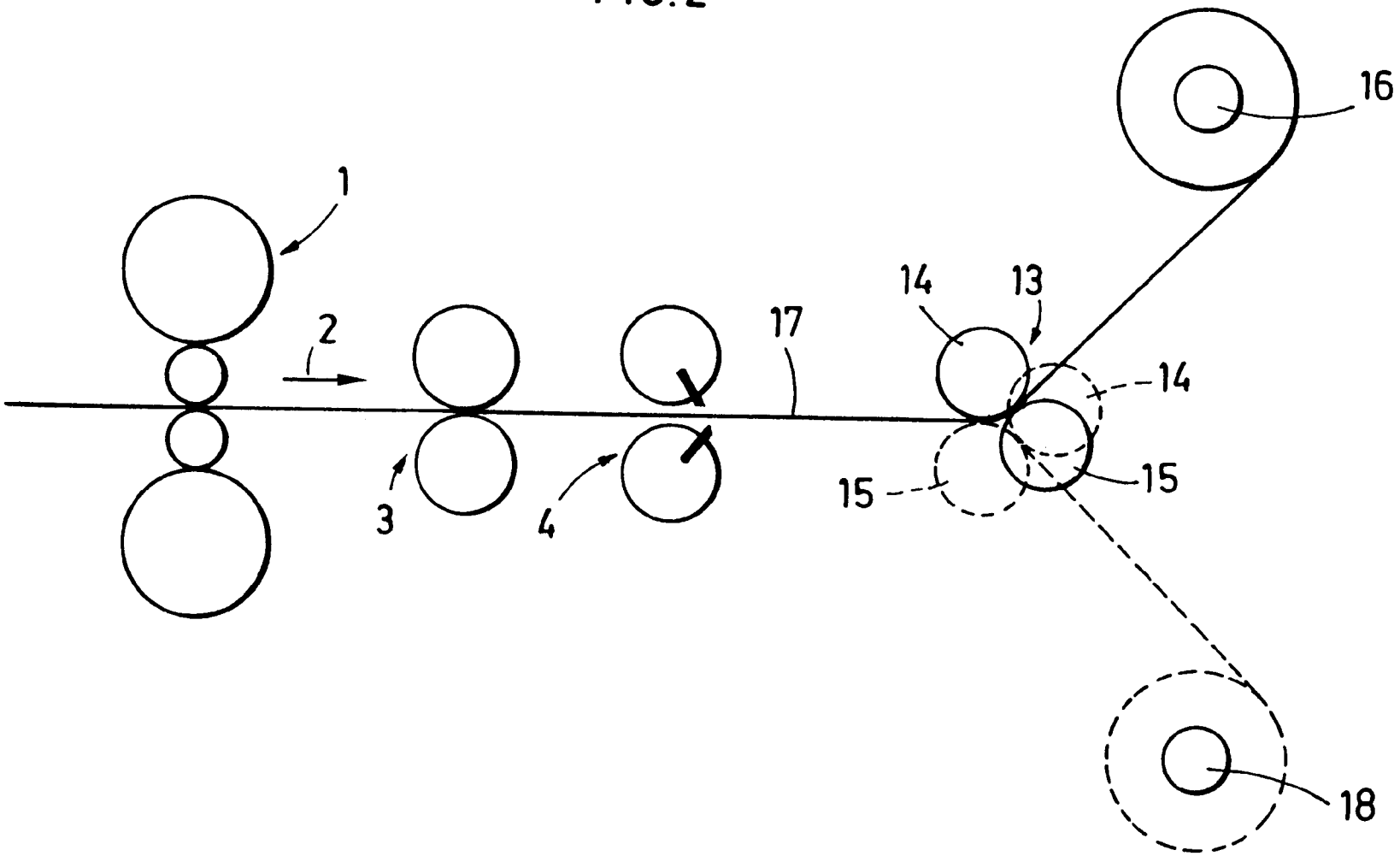
FIG. 2 is a schematic view of another embodiment of a reeling device at the exit of a continuous rolling mill train.

FIG. 2 of the drawing also shows the stand 1, the driver 3, the flying shears 4 and a driver 13. A shown in FIG. 2, the driver roll 14 is offset relative to the roll 15 against the strip travel direction, so that the strip beginning is deflected toward the reel 16. During the process of reeling the strip onto the reel 16, the roll 14 can be pivoted in the strip travel direction in such a way that, after the strip 17 has been cut by the shears 4, the new strip beginning travels onto the reel 18. FIG. 2 further shows that the roll 14 as well as the roll 15 of the driver 13 can be adjusted horizontally in order to achieve an optimum deflection of the strip toward the reels 16, 18. The adjustment of the roll 14 or the roll 15 can be effected by a position regulating unit.

Figure 2A:
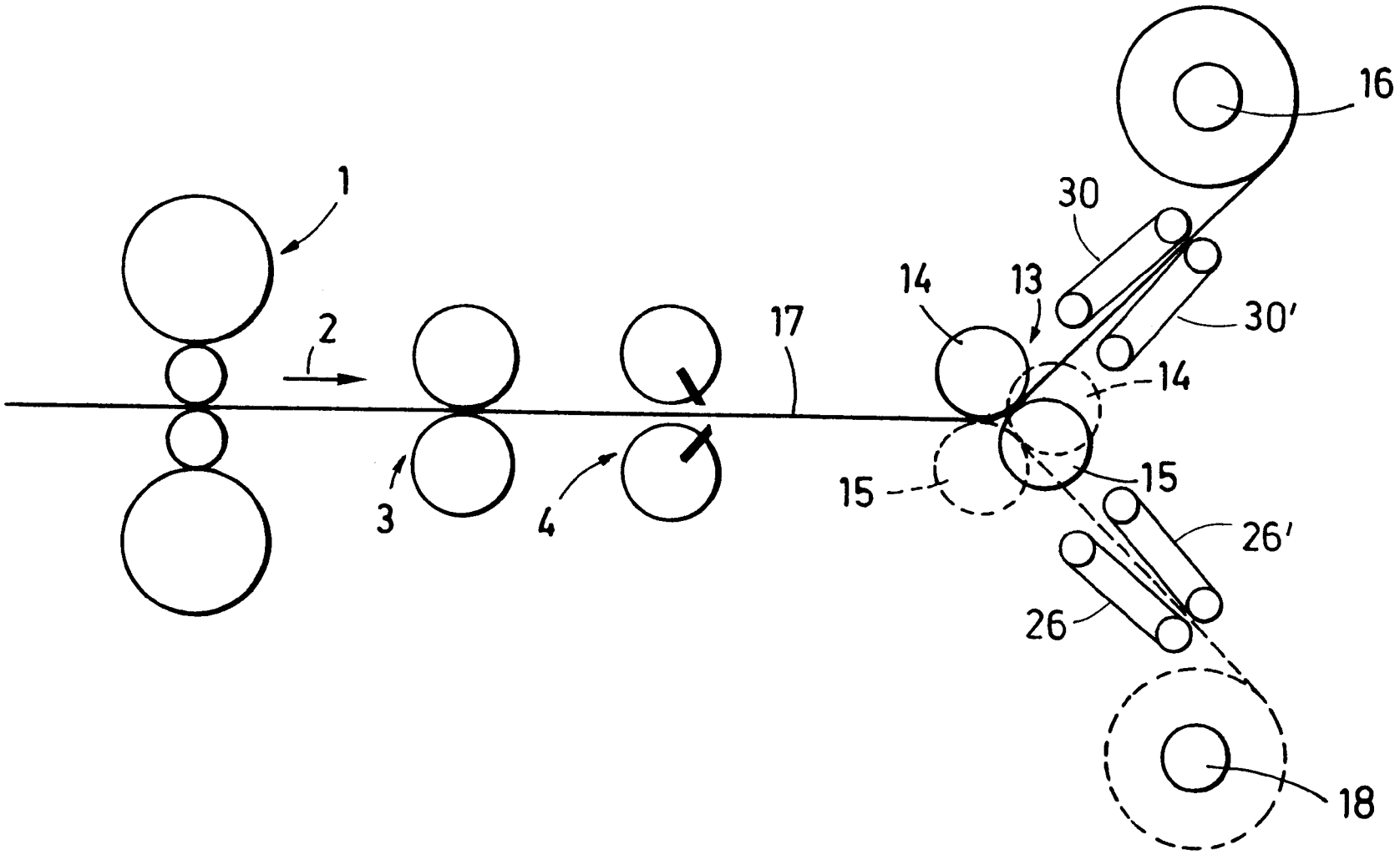
FIG. 2*a* is a schematic view of a reeling device according to FIG. 2 with guide belts for the rolled strip.

FIG. 2*a* shows guide belts 26, 26'; 30, 30' which, similar to the guide belts of FIGS. 1*a* and 1*b*, have the purpose of conveying the rolled strip, particularly the strip beginning, without obstacle onto the reels 16, 18.

Figure 3:
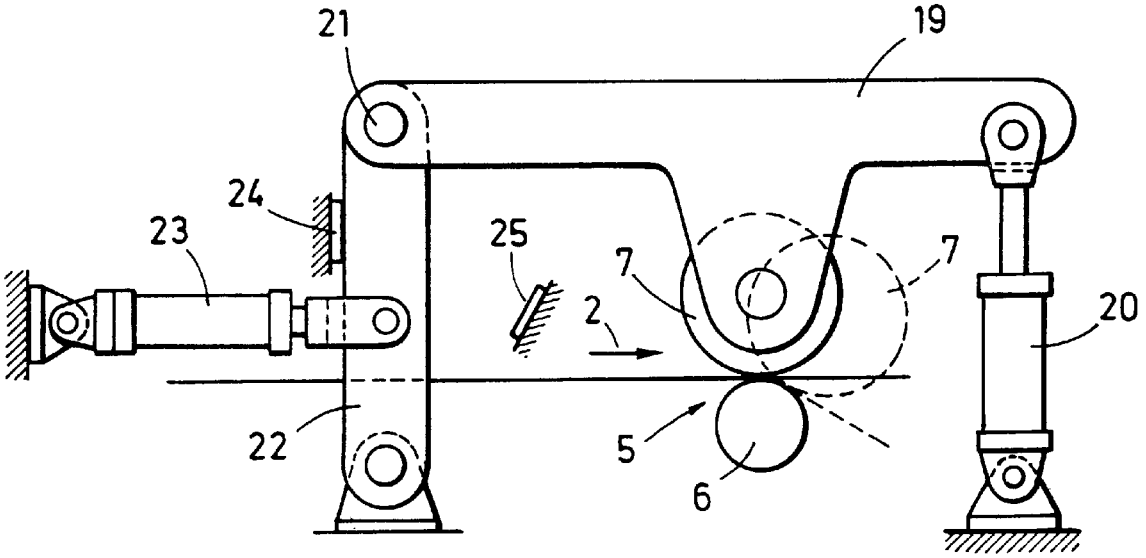
FIG. 3 is a schematic view of an adjustment and horizontal displacement unit for one of the driver rolls.

FIG. 3 shows the driver 5 whose roll 6 is rotatable but mounted so as to be stationary. The roll 7 is mounted so as to be adjustable in vertical direction by means an adjustment drive 20 acting on a pair of support members, wherein only the support member 19 is shown. The bearing 21 of the support member 19 is connected to a pivot lever 22 which is pivotable by means of a pivoting drive 23, so that roll 7 can be displaced in the strip travel direction to or against the strip travel direction 2. As shown in FIG. 3, the pivot lever 22 is pulled by the drive 23 against a stop 24, so that the support member 19 is secured in this position. In this position of the rolls 6, 7 the strip is guided in a straight line through the driver 5. The drive 23 is capable of pressing the pivot lever 22 against the stop 25, so that the roll 7 is securely adjusted into the position shown in broken lines. In the position of the roll 7 shown in broken lines, the strip, also shown in broken lines, is deflected and is no longer guided in a straight line through the driver 5.

While specific embodiments of the invention have been shown and described in detail to illustrate the inventive principles, it will be understood that the invention may be embodied otherwise without departing from such principles.

I claim:

1. A device for alternatingly operating one of a plurality of reels arranged following a continuous strip rolling train, wherein flying shears are arranged at an exit of the rolling mill train for cutting continuously arriving rolling stock into coil weights of desired lots, the device comprising a driver arranged following the flying shears, the driver comprising a first roll and a second roll in contact with the first roll and an arrangement acting on the rolls for horizontally and vertically displacing the first roll in a strip travel direction or against the strip travel direction, further comprising a pair of support members for supporting the first roll, and pivot bearings for the support members, wherein the pivot bearings are mounted so as to be vertically adjustable and horizontally adjustable in the strip travel direction, such that the rolling stock is deflected in dependence on a position of the first roll relative to the second roll.

2. The device according to claim 1, comprising a control unit for adjusting the arrangement for horizontally displacing one of the driver rolls after the strip beginning is grasped by one of the reels during the operation of the one of the reels.

3. The device according to claim 1, wherein the pivot bearings of the support members are mounted at free ends of pivot levers.

4. The device according to claim 3, comprising stops for limiting a pivoting path of the pivot levers.

5. The device according to claim 3, further comprising adjustment drives for adjusting the support members and pivoting drives for pivoting the pivot levers.

6. The device according to claim 5, comprising a position regulating unit acting on the pivoting drive for adjusting the pivoting path of the pivoting levers.

7. The device according to claim 1, comprising guide belts for guiding the rolling stock arranged following the at least one driver and in front of the reels.

8. The device according to claim 7, wherein the guide belts are pairs of endless conveyor belts for guiding the rolling stock therebetween and for conveying the rolling stock, wherein the guide belts are operated essentially at a strip travel speed.

9. The device according to claim 7, wherein each pair of guide belts forms an inlet funnel for the rolling stock.

* * * * *